United States Patent [19]

Williams

[11] Patent Number: 4,836,177

[45] Date of Patent: Jun. 6, 1989

[54] ARCHERY BOW WRIST BRACE APPARATUS

[75] Inventor: Bill R. Williams, Durant, Okla.

[73] Assignee: Larry B. Wills, Durant, Okla. ; a part interest

[21] Appl. No.: 202,120

[22] Filed: Jun. 2, 1988

[51] Int. Cl.[4] ..... F41B 5/00

[52] U.S. Cl. ..... 124/89; 124/88

[58] Field of Search ..... 124/88, 89, 86, 24 R, 124/20 R

[56] References Cited

U.S. PATENT DOCUMENTS

| | | | |
|---|---|---|---|
| 3,055,354 | 9/1962 | Gates | 124/30 |
| 3,416,508 | 12/1968 | Thompson | 124/24 |
| 3,572,312 | 3/1971 | Foster | 124/30 |
| 3,599,621 | 8/1971 | Scrobell | 124/23 |
| 3,865,094 | 2/1975 | Sweeney | 124/20 R |
| 3,875,923 | 4/1975 | Horel | 124/20 |
| 4,250,861 | 2/1981 | Ellenburg | 124/20 |
| 4,343,286 | 8/1982 | Thacker | 124/24 R |
| 4,714,071 | 12/1987 | Saunders | 124/88 |

OTHER PUBLICATIONS

Supplemental Reference 1987 Spring Edition of "Bow Hunters" Sales Catalog, p. 57.

*Primary Examiner*—Randolph A. Reese
*Assistant Examiner*—Carol I. Bordas
*Attorney, Agent, or Firm*—Hubbard, Thurman, Turner & Tucker

[57] ABSTRACT

An archery bow wrist brace has an externally padded, generally U-shaped rigid frame having an open front end which is anchored to a connecting bracket secured to a lower front portion of the bow handle. From their juncture with the bow handle the frame legs extend rearwardly of the handle to one side of the bow string and are positioned beneath the wrist and forearm of the archer's bow hand as it operatively grips the bow handle. The closed rear end of the padded frame is upwardly and rearwardly bent, and passes over and engages the forearm. Immediately in front of the bent rear frame end the padded frame legs are interconnectable with a tightening strap structure which passes beneath and engages the forearm. The bent rear frame end and the tightening strap structure cooperate to lock the forearm against appreciable transverse movement relative to the frame legs, thereby bracing the bow hand wrist and inhibiting undesirable pivoting of the bow body caused by string draw and release torques imposed thereon.

22 Claims, 2 Drawing Sheets

ARCHERY BOW WRIST BRACE APPARATUS

BACKGROUND OF THE INVENTION

The present invention relates generally to archery equipment and, in a preferred embodiment thereof, provides unique bow hand wrist brace apparatus which is adjustably securable to a bow handle and functions to stabilize the bow body against undesirable pivotal movement thereof during string draw and release.

Particularly when an archery bow is provided with a relatively high draw weight (the rearward string force required to flex the bow body to its fully drawn position), various undesirable torques are imposed on the bow body as the bow string is drawn and then released. These torques manifest themselves about the archer's hand which tightly grips the bow handle and include first and second torques which tend to rotate the bow handle in opposite directions in the archer's hand, about a generally vertical axis, as the string is respectively drawn and released, and third and fourth torques which tend to tip the upper bow limb toward and away from the archer during string draw and release, respectively.

Each of these string force-related torques tends to undesirably affect aiming of the arrow, and the accuracy of the arrow's flight path, and additionally can strain and flex the wrist of the bow holding hand. In the past, various proposals have been made to compensate for these unavoidable bow torques.

Perhaps the most common approach has been for the archer to hold the bow handle with an open-handed grip such that the fingers of the bow holding hand extend along one side of the bow handle generally in the direction of arrow flight, with the bow handle being received in the crook between the thumb and first finger. When the arrow is released, the resulting string shock drives the bow forwardly out of the archer's bow hand without tending to twist his wrist. Since the open bow holding hand cannot effectively exert a counter torque on the bow during either string draw or release, the bow handle simply finds its own balanced position in the hand during string draw.

To keep the bow from simply falling to the ground when the arrow is released, a variety of flexible sling loops have been utilized, such loops typically being secured to the bow handle and being looped over or under the archer's wrist such that when the bow springs forwardly from the open bow hand upon arrow release the sling loop "catches" the freely moving bow. Flexible sling loops of this type, while not intended to counter bow torque, can, if suitably tightened between the bow handle and wrist offset bow "tipping" in one direction (depending upon whether the sling is looped over or under the archer's wrist). They cannot, however, counter the other three previously mentioned types of bow torques. In fact, it is considered by advocates of the open-handed handle grip technique to be undesirable for a flexible sling of this type to exert any torsional counterforce on the bow.

While this open-handed grip technique is, when used by an experienced archer, a highly accurate shooting method, it is a somewhat unnatural method of holding a bow handle and many archers (particularly bow hunters) prefer to tightly grip the bow handle when shooting. This grip, however, transmits the four previously mentioned types of bow torques to the bow hand wrist, tending to flex it and thereby lessen aiming and shooting accuracy.

In view of the foregoing, it is accordingly an object of the present invention to provide a device which will enable an archer to tightly grip a bow handle with a closed hand without causing a significant amount of the previously encountered bow torque-related shooting inaccuracies.

SUMMARY OF THE INVENTION

In carrying out principles of the present invention, in accordance with a preferred embodiment thereof, an archery bow is provided with a wrist brace which is interconnectable between the bow handle and the forearm of the archer's handle-gripping bow hand in a manner inhibiting flexure of his wrist and stabilizing the bow body against undesirable pivotal motion caused by string draw and release torques imposed thereon.

From a functional standpoint, the wrist brace comprises a rigid portion having first and second ends, connecting means for anchoring the first end of the rigid portion to the bow body in a manner such that the rigid portion extends rearwardly from the bow body to one side of the bow string with the second end of the rigid portion positioned rearwardly of the bow hand wrist, and engagement means, secured to the second end of the rigid portion, for encirclingly engaging the forearm and locking it against appreciable transverse movement relative to the rigid portion of the wrist brace.

In its preferred embodiment, the wrist brace includes an externally padded, generally U-shaped rigid frame having an open front end which is anchored to a connecting bracket secured to a lower front side portion of the bow handle. From their juncture with the bow handle, the frame legs extend rearwardly of the handle to one side of the bow string and are positioned generally beneath the wrist and forearm of the archer's bow hand as it operatively grips the bow handle. The closed rear end of the padded frame is upwardly and rearwardly bent, and passes over and bracingly engages upper and adjacent opposite side surfaces of the forearm. Immediately in front of the bent rear frame end, the padded frame legs are interconnectable by means of a tightening strap structure which passes beneath and bracingly engages an undersurface of the forearm. The bent rear frame end and the tightening strap structure cooperate to lock the forearm against appreciable transverse movement relative to the handle-anchored frame legs, thereby bracing the bow hand wrist and inhibiting undesirable pivoting of the bow body caused by string draw and release torques imposed thereon.

Thus, when the bow string is drawn, the engagement between the rear end of the frame and the upper surface and an adjacent first side surface of the forearm substantially prevents rearward tipping of the upper bow limb and pivoting of the bow handle, about a vertical axis, in a first direction in the archer's bow hand. Similarly, when the bow string is released, the respective engagement of the tightening strap structure and the rear frame end with an undersurface portion and a second side surface of the forearm substantially prevents forward tipping of the upper bow limb and pivoting of the bow handle, about a vertical axis, in a second direction in the archer's bow hand.

The wrist brace is of a simple and quite inexpensive construction and is easily and quickly removable from and attachable to the bow handle. In addition to its accuracy improving function, the wrist brace is also quite useful to archer with weak or injured wrists since the brace uniquely functions to transfer bow torque directly from the bow handle to the archer's forearm so that he need not resist bow torque with his bow hand wrist. The wrist brace is easily connectable to all types of archery bows and may be conveniently manufactured in both left and right hand versions.

DETAILED DESCRIPTION

Figure 1:
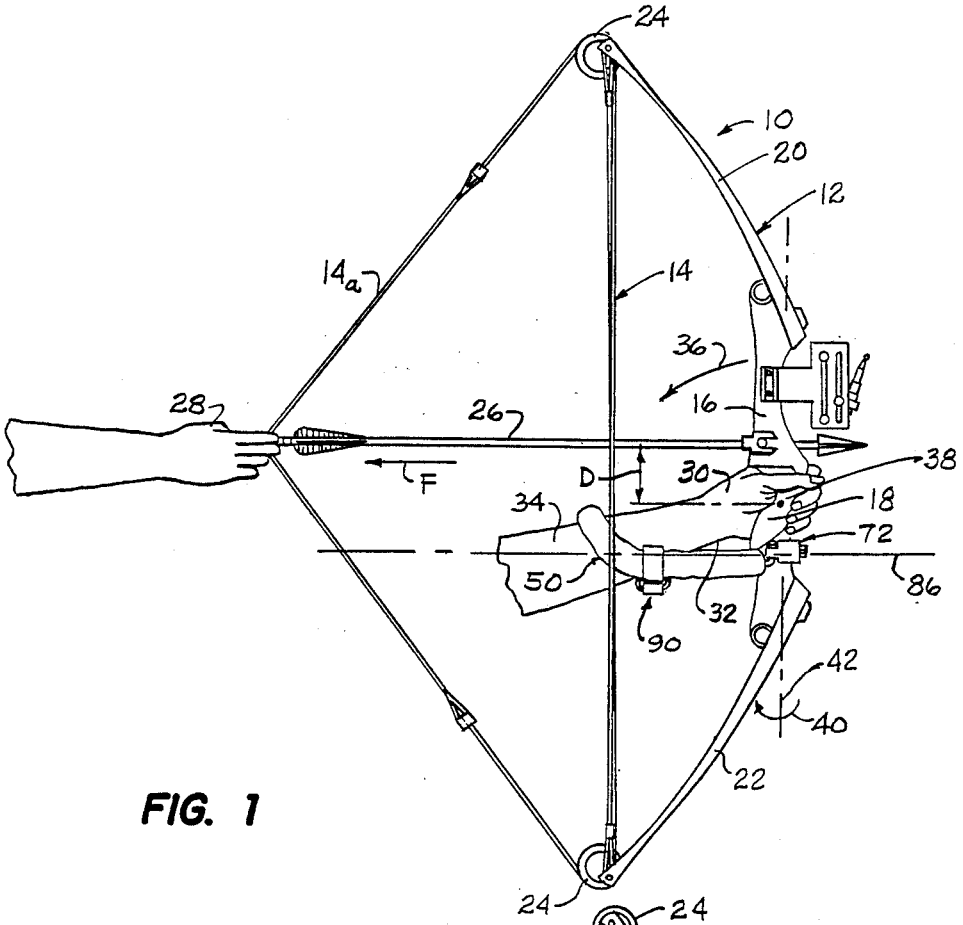
FIG. 1 is a side elevational view of a compound archery bow having incorporated therein a bow hand wrist brace embodying principles of the present invention, the bow being illustrated in its fully drawn position prior to string release and arrow propulsion.

Illustrated in FIG. 1 in its fully drawn position is a compound hunting bow 10 having an elongated body portion 12 and a string portion 14. Body portion 12 includes an essentially straight central section 16 having an intermediately disposed handle portion 18, an upper limb 20 secured at an inner end thereof to the upper end of the central section 16, and a lower limb 22 secured at its inner end to the lower end of the central section 16. A pair of pulleys 24 are secured to the outer ends of limbs 20 and 22, and the string portion 14, in a conventional manner, is anchored at its opposite ends to the outer limb ends and is passed around the pulleys 24, the string portion 14 having a draw section $14_a$ positioned somewhat rearwardly (i.e., leftwardly as viewed in FIGS. 1 and 2) of the balance of string portion 14.

Figure 2:
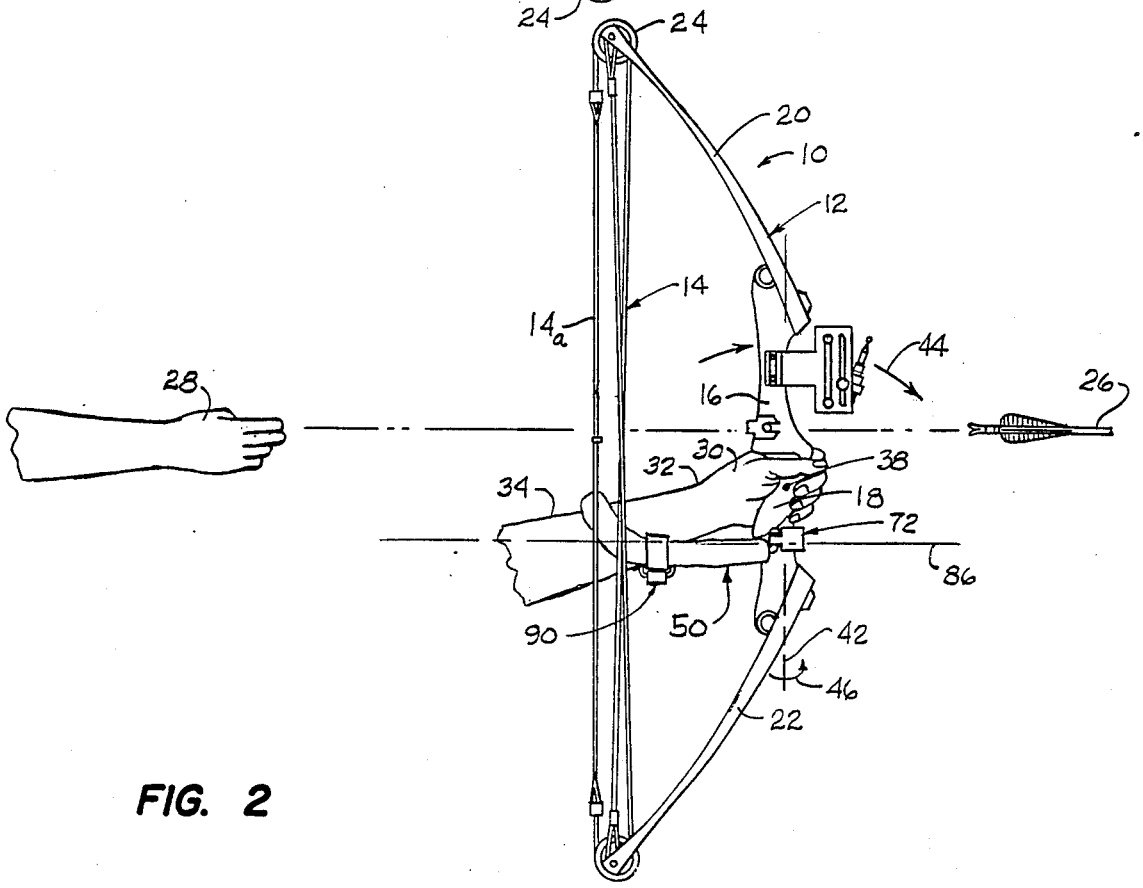
FIG. 2 is a view similar to that in FIG. 1, but with the drawn string released and the arrow beginning its string-propelled trajectory.
Figure 3:
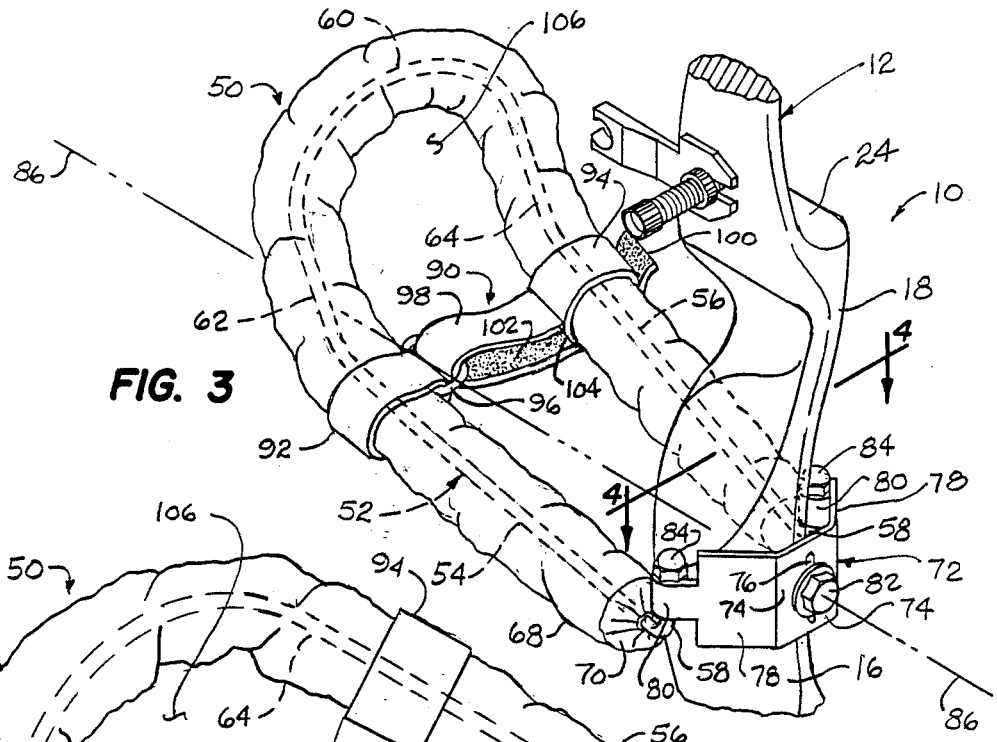
FIG. 3 is an enlarged scale perspective view of the wrist brace and a handle portion of the bow to which the wrist brace is adjustably secured.

As best illustrated in FIG. 3, the handle 18 is provided along one side of its upper end with an arrow rest ledge 24 which is adapted to support the shaft of an arrow 26 before and during the shooting process. With the arrow shaft supported on ledge 24, and the notched rear end of the arrow knocked on the string draw portion $14_a$, the archer grasps the rear end of the arrow and the string draw portion $14_a$ with his string hand 28, while firmly gripping the handle 18 with his bow hand 30, and then pulls the sting draw portion $14_a$ rearwardly to bring the bow 10 to its fully drawn position illustrated in FIG. 1. With the bow in this fully drawn position, the wrist and forearm 32, 34 associated with the bow hand 30 (the archer's left hand in FIGS. 1 and 2) are positioned to the left of the string portion 14 (as viewed by the archer). Because of the positioning of the hand 30, wrist 32 and forearm 34 relative to the bow handle 18 and the string portion 14, two primary torques are exerted on the body portion 12 of the bow in its drawn position.

Torque 36, which tends to tip the upper limb 20 toward the archer, is exerted on the body portion 12 in a counterclockwise direction about a horizontal axis 38 passing centrally through the bow hand 30 and is equal to $F \times D$ wherein F is the draw force being exerted on the string draw portion $14_a$, and D is the vertical distance between the center line of the arrow shaft and the axis 38. Torque 40, which tends to rotate the bow handle 18 in a clockwise direction in the bow hand 30, as viewed from the top end of the bow, is exerted about a vertical axis 42 which extends centrally through the bow handle 18 and the bow hand 30 which grasps it.

When the string draw portion $14_a$ is released from the string hand 28 as illustrated in FIG. 2, thereby allowing the bow body 12 to snap back to its unflexed position and rightwardly propel the arrow 26, the resulting string shock creates two different torques on the bow body 12. Torque 44, which tends to tip the upper limb 20 away from the archer, is exerted in a clockwise direction about the axis 38, while torque 46, which tends to rotate the handle 18 in a counterclockwise direction within the hand 30 as viewed from the top of the bow, is exerted about the vertical axis 42.

Because the handle 18 is being tightly gripped by the bow hand 30, each of the torques 36, 40, 44 and 46 would ordinarily be transmitted directly to the gripping hand 30 and its associated wrist 32, thereby tending to flex the wrist in a manner causing undesirable bow body movements with resulting arrow aiming and flight inaccuracies. However, the present invention provides a unique wrist brace device 50 which, as will subsequently be described herein, functions to counteract these torques in a manner permitting the closed hand handle grip illustrated in FIGS. 1 and 2 without the aiming and shooting inaccuracies normally associated therewith.

Figure 4:
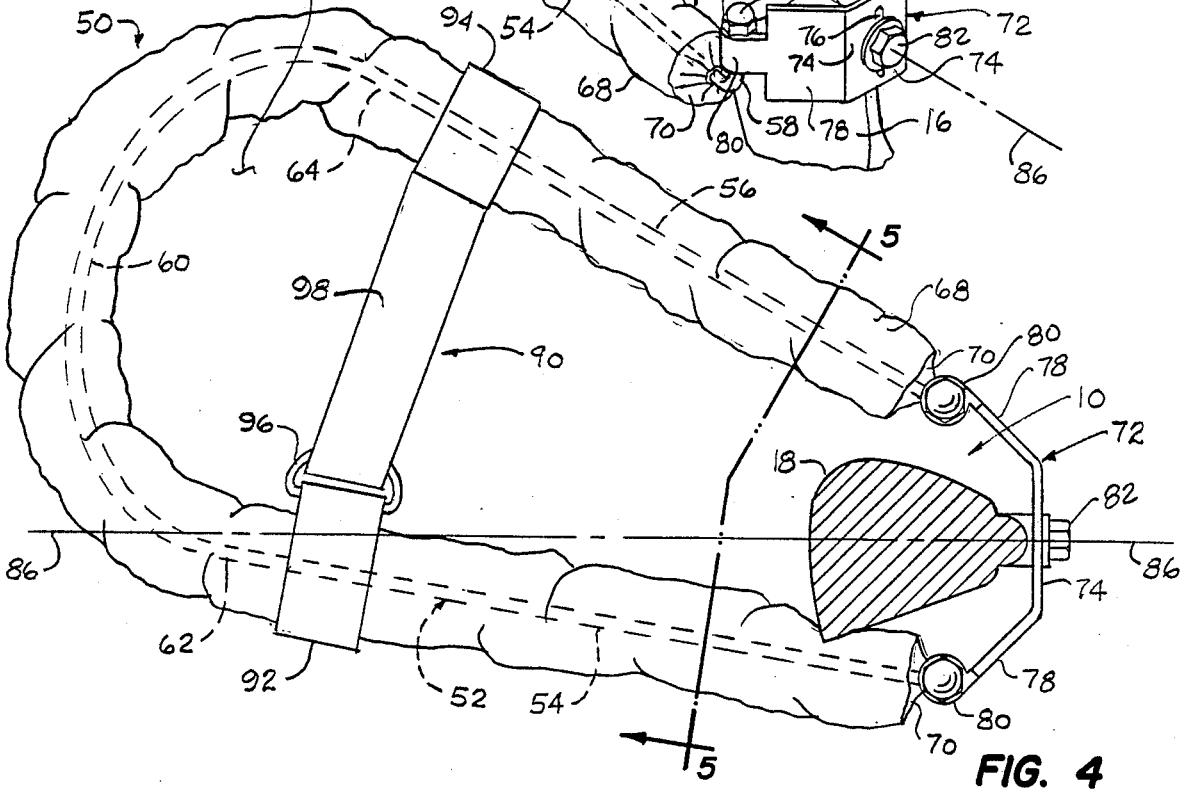
FIG. 4 is an enlarged scale cross-sectional view through the bow handle along line 4—4 of FIG. 3.
Figure 5:
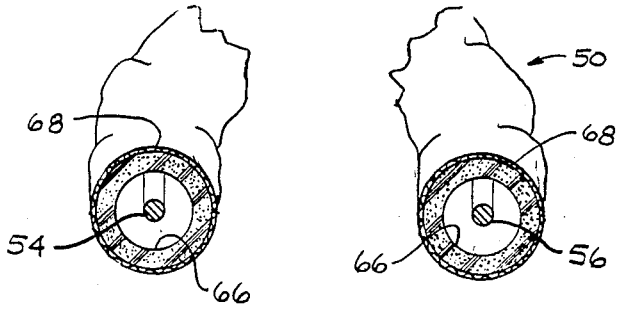
FIG. 5 is a partial, fragmentary cross-sectional view through the wrist brace taken along line 5—5 of FIG. 4.

Referring now to FIGS. 3–5, the wrist brace 50 includes a generally U-shaped rigid internal frame 52 formed from a suitable length of circular metal rod stock. The frame 52 has a pair of elongated, laterally spaced front leg portions 54 and 56 having externally threaded, upturned front end portions 58. The closed end of frame 56 is defined by an arcuate rod section 60 which is respectively joined to the rear or left ends of the legs 54, 56 by upwardly and rearwardly sloped straight transition sections 62 and 64 of the frame. For purposes later described, the frame leg 56 is somewhat shorter than the leg 54 and is forwardly and inwardly angled relative thereto so that its upturned end portion 58 is spaced to one side of and rearwardly of the upturned end portion 58 of leg 54.

The rigid frame 52 is externally padded by means of an elongated, hollow cylindrical sheath section of closed cell foam rubber material 66 (FIG. 5), such as that commonly used as pipe insulation, which is simply slipped over one leg end of the frame and then pushed around the frame to the other leg end. To facilitate this installation of the foam rubber sheath section 66 on the frame, the inner diameter of section 66 is made considerably larger than the diameter of the frame rod as best illustrated in FIG. 5. The sheath section 66 is covered with a suitable jacket fabric 68 which is closed at its opposite ends 70 over the outer ends of the sheath section 66.

The wrist brace 50 is anchored to the bow handle 18 by means of a generally U-shaped mounting member in the form of a bracket 72 having a base wall 74 with a vertical slot 76 formed therein, and a pair of rearwardly and outwardly sloped end walls 78 having hollow cylindrical support bosses 80 at their outer ends. Bracket 72 is secured to a lower front side portion of the bow handle 18 by means of a mounting bolt 82 which is extended inwardly through the bracket slot 76 and threaded into the handle 18. The wrist brace 50 is anchored to the mounting bracket 72 by passing the threaded, upturned frame leg ends 58 upwardly through the bracket bosses 80 and then tightening retaining nuts 84 onto the upper ends of the leg ends 58. The vertical position of bracket 72, and thus the brace 50, relative to handle 18 may be easily and quickly adjusted simply by loosening bolt 82, sliding the bracket upwardly or downwardly along the handle, and then retightening the bolt 82 to again clamp the bracket base 74 between the handle and the head of bolt 82.

The previously mentioned longitudinally offset relationship between the ends 58 of the frame legs 54, 56 horizontally cants the brace rearwardly and leftwardly (as viewed by the archer) relative to a reference axis 86 passing transversely through handle 18 and string portion 14. This offsets a rear end portion of brace 50 (and the forearm 34 supported thereby) to the left of string draw portion $14_a$ to prevent the brace 50 from interfering with the operative movement thereof.

Intersecurable between rear end portions of the frame legs 54, 56 immediately forwardly, of the frame transition sections 62, 64 is a tightening strap structure 90 which includes a strap loop 92 that circumscribes and is suitably anchored to the jacket fabric 68 adjacent the rear end of the frame leg 54, and a strap loop 94 circumscribing and suitably anchored to the jacket fabric 68 adjacent the rear end of frame leg 56. A metal D-ring 96 is captively retained by the strap loop 92, and an elongated fastening strap 98 is secured at one end to the strap loop 94 and has a free end 100. A suitable fastening pile material 102 (FIG. 3) is adhered to the underside of the fastening strap 98, and a cooperating fastening hook material 104 is secured to the lower peripheral side surface of the strap loop 94.

To use the brace 50, the archer inserts his bow hand 30 upwardly through the bent, closed end section of the brace rearwardly of the strap structure 90 and grasps the bow handle 18. He then inserts the free end 100 of the strap 98 downwardly through the D-ring 96, pulls the free end 100 toward the strap loop 94 to tighten the strap 98 between the externally padded frame sides, and then secures the fastening pile material 102 adjacent the strap end 100 to the fastening hook material 104 to releasably lock the tightened strap 98 in place. As best illustrated in FIGS. 3 and 4, the tightened strap 98 defines with the externally padded frame sections 60, 62 and 64 a rear brace end opening 106 through which the forearm 34 extends.

With the brace 50 secured in this manner to the forearm 34, the arcuate, padded frame section 60 engages an upper surface of the forearm, the padded frame transition sections 62 and 64 engage and extend downwardly and forwardly along opposite side surfaces of the forearm, and the tightened strap 98 extends beneath and engages a lower side surface portion of the forearm forwardly of the arcuate frame section 60. A rear end portion of the frame 50 defined by the frame sections 60, 62 and 64 and the strap 98 thus encircles and peripherally engages the forearm 34, thereby effectively locking the forearm against appreciable transverse movement relative to the rigid front portion of the frame 50 defined by its legs 54 and 56.

It can accordingly be seen that due to the rigid connection of the frame 52 to the handle 18 via the mounting bracket 72, the previously described bow body torques 36, 40, 44 and 46 are transmitted directly from the bow handle 18 to and effectively resisted by the forearm 34, in effect "bypassing" the bow hand wrist 32. Specifically, the torque 36 is resisted by the engagement of the padded frame section, 60 with the upper surface of the forearm 34, the torque 40 is resisted by the engagement of the padded frame section 62 with one side of the forearm, the torque 46 is resisted by the engagement of the frame section 64 with the opposite side of the forearm, and the torque 44 is resisted by the engagement of the tightening strap with a lower side surface portion of the forearm. Accordingly, through the entire string draw and release cycle, these four torques are effectively countered by the forearm 34, instead of the weaker wrist 32, due to the stabilizing, essentially rigid bracing interconnection between the forearm 34 and the bow handle 18 provided by the wrist brace 50.

This stabilizing interconnection between the forearm and the bow handle substantially minimizes aiming and shooting inaccuracies previously associated with the torques 36, 40, 44 and 46 when the bow hand 30 grips the handle 18 as illustrated in FIGS. 1 and 2, and further significantly reduces the strain on the bow hand wrist 32.

While the wrist brace 50 has been illustrated and described herein in conjunction with a compound bow 10, it will readily be appreciated that it could be just as easily secured to bows of other types such as recurve bows or straight bows. Additionally, the wrist brace 50 has been described herein in a right handed version thereof. However, it could just as easily be made in a left handed version simply by shortening the frame leg 54 and lengthening the frame leg 56 so that the installed brace would be canted rightwardly relative to the reference axis 86.

The wrist brace 50 may be easily and inexpensively fabricated from ordinary and readily available materials, may be quickly and easily installed on a variety of bows, and is easily adjustable to suit various shooting styles by virtue of the vertical adjustment incorporated in the mounting bracket 72. The brace is quite comfortable to use and significantly facilitates the operation of high draw weight bows due to its previously described wrist stabilizing features.

The foregoing detailed description is to be clearly understood as being given by way of illustration and example only, the spirit and scope of the present invention being limited solely by the appended claims.

What is claimed is:

1. For use with an archery bow having an elongated body with a central handle portion adapted to be gripped by an archer's bow hand having an associated wrist and forearm, and a bow string operatively intersecured between opposite ends of said body and adapted to be rearwardly drawn by the archer's string hand and then released to forwardly propel an arrow operatively engaged by said bow string, the draw and release of said bow string creating undesirable torques on said body in opposite directions about horizontal and vertical axes passing through said handle portion being gripped by said bow hand, a wrist brace operative to inhibit flexure of said wrist to thereby inhibit undesirable pivoting of said body about said axes, said wrist brace comprising:

a rigid portion having first and second ends;

connecting means for rigidly anchoring said first end of said body in a manner such that said rigid portion extends rearwardly from said body to one side of said bow string with said second end positioned rearwardly of said wrist; and engagement means, secured to said second end of said rigid portion, for encirclingly engaging said forearm and locking it against appreciable transverse movement relative to said rigid portion in a manner such that all movements of said body about horizontal and vertical axes passing through said handle are resisted by said forearm.

2. The wrist brace of claim 1 wherein:

said connecting means are operative to anchor said first end of said rigid portion to said handle portion of said bow, and to position said rigid portion generally beneath said bow hand, wrist and forearm when the archer operatively grips said handle portion of said bow with said bow hand.

3. The wrist brace of claim 2 wherein said connecting means include:

a connecting bracket member, means for securing said connecting bracket member to said handle portion of said bow, and means for anchoring said first end of said rigid portion to said bracket member.

4. For use with an archery bow having an elongated body with a central handle portion adapted to be gripped by an archer's bow hand having an associated wrist and forearm, and a bow string operatively intersecured between opposite ends of said body and adapted to be rearwardly drawn by the archer's string hand and then released to forwardly propel an arrow operatively engaged by said bow string, the draw and release of said bow string creating undesirable torques on said body in opposite direction about horizontal and vertical axes passing through said handle portion being gripped by said bow hand, a wrist brace operative to inhibit flexure of said wrist to thereby inhibit undesirable pivoting of said body about said axes, said wrist brace comprising:

a rigid portion having first and second ends;

connecting means for anchoring said first end to said body in a manner such that said rigid portion extends rearwardly from said body to one side of said bow string with said second end positioned rearwardly of said wrist; and engagement means, secured to said second end of said rigid portion, for encirclingly engaging said forearm and locking it against appreciable transverse movement relative to said rigid portion, said connecting means being operative to anchor said first end of said rigid portion to said handle portion of said bow, and to position said rigid portion generally beneath said bow hand, wrist and forearm when the archer operatively grips said handle portion of said bow with said bow hand, said connecting means including a connecting bracket member, means for securing said connecting bracket member to said handle portion of said bow, and means for anchoring said first end of said rigid portion to said bracket member, said connecting bracket member having a base portion with a vertical slot therein, and said means for securing including a threaded fastening member slidably extendable through said slot and threadable into said handle portion to releasably clamp said base portion to said handle portion, whereby the height of said connecting bracket member, and thus said wrist brace, relative to said handle portion may be selectively adjusted by loosening said fastening member, vertically moving said bracket to an adjusted position on said handle portion, and then retightening said fastening member.

5. For use with an archery bow having an elongated body with a central handle portion adapted to be gripped by an archer's bow hand having an associated wrist and forearm, and a bow string operatively intersecured between opposite ends of said body and adapted to be rearwardly drawn by the archer's string hand and then released to forwardly propel an arrow operatively engaged by said bow string, the draw and release of said bow string creating undesirable torques on said body in opposite directions about horizontal and vertical axes passing through said handle portion being gripped by said bow hand, a wrist brace operative to inhibit flexure of said wrist to thereby inhibit undesirable pivoting of said body about said axes, said wrist brace comprising:

a rigid portion having first and second ends;

connecting means for anchoring said first end to said body in a manner such that said rigid portion extends rearwardly from said body to one side of said bow string with said second end position rearwardly of said wrist; and engagement means, secured to said second end of said rigid portion, for encircingly engaging said forearm and locking it against appreciable transverse movement relative to said rigid portion, said connecting means being operative to anchor said first end of said rigid portion to said handle portion of said bow, and to position said rigid portion generally beneath said bow hand, wrist and forearm when the archer operatively grips said handle portion of said bow with said bow hand, said rigid portion comprising a duality of laterally spaced rigid leg members having first end portions which define said first end of said rigid portion, and second end portions which define said second end of said rigid portion, said engagement means comprising a bent rigid member secured at opposite ends thereof to second end portions of said leg members and configured to extend around and bear against an upper side surface and adjacent opposite side surface portions of said forearm, and flexible strap means operatively interconnectable between said second end portions of said leg members and tightenable to bear against an undersurface portion of said forearm.

6. The wrist brace of claim 5 wherein:

said leg members and said bend rigid member are externally padded.

7. The wrist brace of claim 5 wherein:

said leg members and said bent rigid member are portions of a rigid frame member formed from a single, continuous length of rigid rod material.

8. The wrist brace of claim 7 wherein:

said first end portions of said leg members are upturned and externally threaded, and said connecting means include a connecting bracket having a base portion having opposite side edges from which a pair of angled end walls outwardly project, means for securing said base portion to said handle portion, a pair of hollow boss members secured to outer end of said end walls and adapted to upwardly receive said upturned first end portions of said leg members, and retaining nut means threadable onto outer ends of said upturned first end portions to anchor them to said boss members.

9. The wrist brace of claim 8 wherein:

one of said upturned first end portions is longitudinally offset relative to the other of said upturned first end portions, and said leg members are angled relative to one another.

10. The wrist brace of claim 7 wherein:

said first end portions of said leg members are externally threaded and angled relative to the balance of said leg members, and said connecting means include a connecting bracket having a base portion having opposite side edges from which a pair of angled end walls outwardly project, means for securing said base portion to said handle portion, a pair of hollow boss members secured to outer end of said end walls and adapted to receive said angled first end portions of said leg members, and retaining nut means threadable onto outer ends of said angled first end portions to anchor them to said boss members.

11. The wrist brace of claim 10 wherein:

one of said angled first end portions is longitudinally offset relative to the other of said angled first end portions, and said leg members are angled relative to one another.

12. Archery apparatus comprising:

a bow having:

an elongated flexible body having a centrally disposed handle portion adapted to be gripped by the bow hand of an archer, said bow hand having associated wrist and forearm portions, and a bow string interconnected between the opposite ends of said body and having a central portion engageable by the string hand of the archer to be rearwardly drawn thereby and then released to forwardly propel an arrow from said body; and wrist brace means, rigidly anchored to and extending rearwardly from said body to one side of said bow string, for forming an essentially rigid bracing interconnection between said bow body and said forearm in a manner preventing appreciable lateral translational movement of said forearm in any direction relative to said bow body, whereby string draw and release torques imposed on said bow body are resisted essentially entirely by said forearm to thereby substantially eliminate undesirable bow hand wrist flexure.

13. The archery apparatus of claim 12 wherein said wrist brace means comprise:

a rigid portion having first and second ends, connecting means for anchoring said first end to said handle portion in a manner such that said rigid portion extends rearwardly from said handle portion to one side of said bow string with said second end positioned rearwardly of said wrist portion, and engagement means, secured to said second end of said rigid portion, for encirclingly engaging said forearm portion and locking it against appreciable transverse movement relative to said rigid portion.

14. The archery apparatus of claim 13 wherein:

said connecting means are operative to position said rigid portion generally beneath said bow hand and associated wrist and forearm portions.

15. Archery apparatus comprising:

a bow having:

an elongated flexible body having a centrally disposed handle portion adapted to be gripped by the bow hand of an archer, said bow hand having associated wrist and forearm portion, and a bow string interconnected between the opposite ends of said body and having a central portion engageable by the string head of the archer to be rearwardly drawn thereby and then released to forwardly propel an arrow from said body; and wrist brace means, anchored to and extending rearwardly from said body to one side of said bow string, for forming an essentially rigid bracing interconnection between said bow body and said forearm in a manner preventing appreciable lateral translational movement of said forearm in any direction relative to said bow body, whereby string draw and release torques imposed on said bow body are resisted essentially entirely by said forearm to thereby substantially eliminate undesirable bow hand wrist flexure, said wrist brace means comprising a rigid portion having first and second ends; connecting means for anchoring said first end to said handle portion in a manner such that said rigid portion extends rearwardly from said handle portion to one side of said bow string with said second end positioned rearwardly of said wrist portion; and engagement means, secured to said second end of said rigid portion, for encirclingly engaging said forearm portion and locking it against appreciable transverse movement relative to said rigid portion, said connecting means being operative to position said rigid portion generally beneath said bow hand and associated wrist and forearm portions, said rigid portion being defined by a duality of elongated, laterally spaced leg members extending longitudinally rearwardly from said handle portion and having rear end portions, and said engagement means comprising a bent rigid member secured to opposite ends thereof to said rear end portions and configured to extend around and bear against an upper surface portion and adjacent opposite side surface portions of said forearm portion, and flexible strap means interconnected between said rear end portions of said leg members and tightenable to bear against an undersurface portion of said forearm portion.

16. The archery apparatus of claim 15 wherein:

said leg members and said bent rigid member define adjacent portions of a generally U-shaped frame formed from a single length of rigid rod material.

17. The archer apparatus of claim 16 further comprising:

an elongated section of tubular padding internally receiving and extending along said frame.

18. Archery apparatus comprising a wrist brace connectable to an archery bow having an elongated flexible body with a centrally disposed handle adapted to be gripped by an archer's bow hand, said bow hand having an associated wrist and forearm, and a string portion operatively interconnected between the opposite ends of said body and adapted to be grasped by the archer's string hand, pulled rearwardly and then released to forwardly propel an arrow from said body, said wrist brace having:

an essentially rigid, generally U-shaped frame having a front portion defined by a laterally spaced duality of legs having front and rear ends, and a bent rear portion angled relative to said legs and having opposite ends joined to said rear ends of said legs;

a mounting member securable to said handle and to said legs to mount said frame on said handle in a manner such that said frame extends rearwardly of said handle to one side of said string portion so that said bow hand may be inserted forwardly through said bent rear portion of said frame to grip said handle with said bent rear portion extending upwardly around said forearm with said legs of said frame extending generally beneath said wrist and forearm; and a strap structure interconnectable and tightenable between said frame legs adjacent said rear ends thereof, and positionable beneath said forearm, the tightened strap structure and said bent rear portion of said frame being relatively configured and positioned in a manner such that, with said bow hand forwardly inserted through said bent rear portion of said frame and gripping said handle, said bent rear portion of said frame exerts a downwardly directed reactive force on an upper surface of said forearm when said string portion is drawn to thereby significantly inhibit rearward tipping of an upper portion of said body, and, when the drawn string portion is released, the tightened strap structure exerts an upwardly directed reactive force on a lower side surface portion of said forearm to thereby significantly inhibit forward tipping of said upper portion of said body.

19. The archery apparatus of claim 18 wherein:

said frame is externally padded with a resilient material.

20. The archery apparatus of claim 18 wherein:

said mounting member is vertically adjustable on said handle to thereby permit vertical adjustment of said wrist brace relative to said handle.

21. The archery apparatus of claim 18 further comprising:

an archery bow having a handle upon which said wrist brace is operatively mounted.

22. The archery apparatus of claim 21 wherein:

said archery bow is a compound bow.

* * * * *